US005193754A

United States Patent [19]

Pujol

[11] Patent Number: 5,193,754

[45] Date of Patent: Mar. 16, 1993

[54] MILL FOR TRITURATING AND BREAKING UP SOLIDS PREDISPERSED IN LIQUIDS

[75] Inventor: Carlos O. Pujol, Badlona, Spain

[73] Assignee: Oliver Y Batlle S.A., Badalona, Spain

[21] Appl. No.: 718,338

[22] Filed: Jun. 19, 1991

[30] Foreign Application Priority Data

Oct. 31, 1990 [ES] Spain ..... 9002766

[51] Int. Cl.[5] ..... B02C 17/16

[52] U.S. Cl. ..... 241/65; 241/172; 241/179; 241/180

[58] Field of Search ..... 241/65, 171, 172, 179, 241/180

[56] References Cited

U.S. PATENT DOCUMENTS 4,651,935 3/1987 Samosky et al. ..... 241/65

4,848,676 7/1989 Stehr ..... 241/33

FOREIGN PATENT DOCUMENTS 0759127 9/1980 U.S.S.R. ..... 241/171

*Primary Examiner*—Mark Rosenbaum

*Assistant Examiner*—John M. Husar

[57] ABSTRACT

Mill for triturating and breaking up solids predispersed in liquids, whose stator consists of two hollow truncated cone-shaped halves connectable to each other by their open major bases provided with flanges, with their minor bases closed and provided with external cooling or heating chambers. The front half presents the grinding body separating means and the outlet connection of the ground product, with its cooling or heating chamber. The rear half presents a central orifice traversed by the rotating shaft of the mill and the inlet connection of the product to be ground. The rotor consists of a body formed by two hollow truncated cones, joined by their open major bases and their minor bases being closed, which are attached to the shaft end. It has a hermetic seal formed by a ring fastened to the shaft, surrounded by a retainer fastened to the rear half of the stator.

2 Claims, 6 Drawing Sheets

MILL FOR TRITURATING AND BREAKING UP SOLIDS PREDISPERSED IN LIQUIDS

Figure 1:
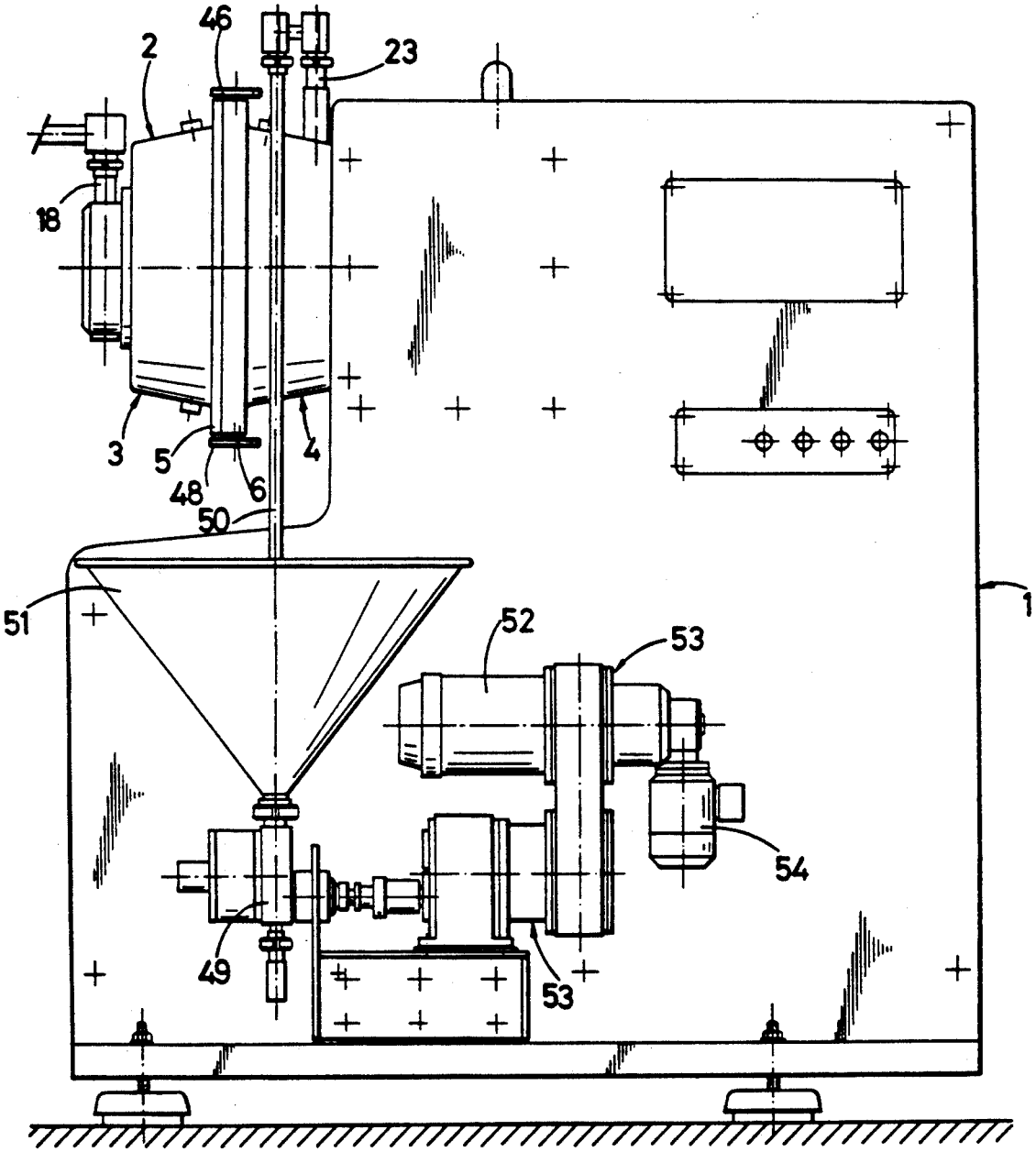

The present Patent of Invention relates to a mill for triturating and breaking up solids predispersed in liquids, which contributes, to the function for which it is intended, several advantages to be indicated below, apart from others inherent in its organization and constitution.

Known are mills, normally with horizontal shaft and cooled, for products consisting of solids predispersed in liquids, of different viscosity, which mills comprise grinding bodies, for example balls, which enter the grinding chamber through the inlet mouth for the product to be treated or through a mouth provided for that purpose; normally they are extracted through an outlet in the bottom of said chamber, which is provided with a double wall for cooling or heating. Said known mills may include a circulating pump for the cooling or heating liquid, said mills having a shaft on which are mounted interchangeable agitation disks disposed at predetermined distances from each other by means of spacers between them, said shaft being driven by a motor via the proper transmission and optionally speed control, and having also a pump, with flow regulator, which impels the product to be treated for its forced and continuous passage through the grinding chamber.

These known mills have a strainer for retaining the grinding bodies inside the grinding chamber while letting only the ground product pass; these strainers consist of a sieve, possibly rotating with the shaft or being static and fixed in the grinding chamber in the outlet zone of the treated product. There are also mills in which the grinding body strainer consists of the so-called "gap" defined by a kind of washer of special material fixed transversely on the shaft of the mill, said washer being disposed at a certain adjustable distance from another washer fixed on the corresponding wall of the grinding chamber and facing it, leaving between them a peripheral clearance smaller than the smallest diameter of the grinding bodies, to retain them inside the grinding chamber, but permitting the passage of the ground product as it is being treated in the mill.

Known also are mills, both with horizontal or vertical shaft, with a cylindrical fixed element or stator and a cylindrical rotating element or rotor disposed in their interior, the grinding chamber being formed between the latter and the cylindrical inner wall of said stator; these mills have a separating device which lets out the ground product but not the grinding bodies; it corresponds to the above described sieve or "gap" strainer; the grinding bodies return to the grinding chamber through passages; and they also have at least a cooling chamber in the stator and sometimes in the rotor.

Also, mills are known like those described before, but in which the grinding chamber is defined by two coaxial cylindrical walls with radial lugs, between which the cylindrical jar-shaped rotor is disposed, also provided with lugs on its two parallel surfaces opposite said two walls.

In addition, there are known mills with horizontal or vertical shaft, provided with at least one fixed element or stator along an annular double cone and with at least one rotor also along an annular double cone and introduced in said stator, that is, the rotor has the form of a circular ring of triagular cross section and is introduced into a circular canal of the stator, which has the same cross section but somewhat larger; in fact the configuration of said stators and rotors is that of a torus of substantially triangular cross section, or possibly of other similar form, both for the stator and for the rotor, the transverse section of the latter being inscribed in the interior of that of the stator and leaving between the two a perimetric space which constitutes the grinding chamber in which the product circulates and in which the balls are enclosed which circulate along a closed path, by means of a return passage of said balls to the beginning of their path. Also the configuration of the rotors in these mills is, sometimes, that of a "disk" of triangular section of revolution with a vertex, normally the most acute, in its peripheral part and, in this case, more than one of such disks can be disposed parallel to each other and transversely to the shaft of the mill, which grinding chambers are connected in series or in parallel, as to the circle to be followed by the product in treatment. In all these known types of mills a sieve type or gap type strainer is disposed, as described above.

Lastly there are known mills of the type described, formed by one or more plates, which have passages for the recirculation in closed circuit of the balls or grinding bodies and each of said plates being disposed inside a hollow body of corresponding configuration and so that between each plate or rotor and its body or stator a grinding chamber is defined more or less in labyrinth form and each chamber communicating with the next one to cause a circulation of the product in treatment, all plates being actuated by a single shaft and there being arranged in the outlet zone of the ground product a strainer or separator, normally of the gap type.

The cited known mills are relatively costly to build, because of their also relatively complex design, and clogging especially of the grinding bodies or balls may occur, particularly in the mills whose rotor and, if applicable, stator have projecting barbs in the grinding chamber or chambers; and difficulties may arise also in the starting of the mill, especially mills with rotors and stators along annular double cones, with the consequent loss of production and the corresponding down time necessary for unclogging and for preparing the mill for normal startup and correct operation.

The grinding bodies may consist of small balls or other suitable geometric forms, and they may be of metal, including various alloys, ceramics, glass, etc., but they must always be resistant to wear and to the stresses deriving from the grinding treatment of the respective products to be ground. As has been stated, the grinding bodies may be balls, but no limitation to spherical bodies is intended; rather, bodies of various configurations are included, able to triturate the solid particles of the products to be ground, by impacts and frictions between themselves and with the limiting surfaces of the grinding chamber, and said grinding bodies are to have dimensions which are a function of the final fineness desired for the solid components of the product to be ground.

In general, these mills are used for the treatment of dyes, paints, pesticides or other chemical products, pharmaceutical, food, cosmetic, electronic products, etc.; having application in the chemical industry in general and, in particular, in the industry of dyes and paints, printing inks, pigments and coatings, the paper industry, for grinding the charges to be used in pulp for making paper and other products such as copy paper, in biochemical industries, in the food industry for innumerable products such as chocolate products, in the electronic industry for coatings of magnetic tapes and of semiconductor products, and in the pharmaceutical and cosmetic industry.

In some of the known types of mills described before, the product to be treated circulates through the grinding chamber in a forced and continuous manner, normally impelled by a pump of variable and adjustable flow, at or near the entrance of the mill.

Lastly it is known also that the grinding bodies exert, in these mills, impact and friction stresses on the solid particles of the product being treated, in that very many contacts occur betwen said grinding bodies and the solid particles of the product in treatment. And the grinding bodies occupy a part of the volume of the grinding chamber which is variable and depends on the characteristics of the product to be treated, but normally the occupied volume of the total volume of said chamber ranges between 50% and 80%. The materials of which the stator and the rotor are made, and in particular as far as their faces in contact with the product in treatment is concerned, must be wear resistant and the working surfaces are normally given hardening treatments.

The mill of the present invention for triturating and breaking up solids predispersed in liquids corresponds to the type which comprises a frame on which is mounted a fixed element or stator, with a jacket for cooling and, if and when applicable, heating the product being treated, in whose interior is disposed a rotating element or rotor fastened to a shaft disposed along the longitudinal axis of the mill and mounted overhung on corresponding supporting and bearing means, attached to the frame of the mill, whose shaft has internal lines for cooling media and, if and when applicable, rotor heating media, and is made to rotate by actuating means through corresponding transmission and speed variation means attached to the frame, there being defined between said stator and rotor the grinding chamber in which grinding bodies are enclosed which are initially introduced into said chamber through a closable entrance of the stator, at the lower part of which is a likewise closable outlet for their evacuation, the grinding chamber being traversed by the product in treatment—while the rotor rotates—owing to impulsion means of said product, which are moved by actuating means and via transmission and speed variation means, the stator having an inlet of the product to be treated, communicating with the outlet of the impulsion means and an outlet of the ground product, in whose outlet zone are disposed separator means which prevent the grinding bodies from coming out but permit the passage of the ground product, there being disposed between the stator and the shaft seal means for preventing leakage of product which circulates in a continuous and forced manner through the grinding chamber.

This mill is characterized in that the stator is composed of two hollow truncated cone-shaped halves, a front and a rear one, with their minor bases closed and joined together by their open major bases in a removable manner, which major bases have outer flanges between which seal means are disposed, and which halves are provided with outer envelopes defining respective cooling and, if and when applicable, heating chambers, each chamber having an inlet connection and an outlet connection of the respective cooling or heating liquid; in that said front half presents, centered on its minor base and in its interior, the separating means of the grinding bodies and, on its exterior, the outlet connection of the ground product, which in turn has a cooling and, if and when applicable, heating chamber, communicating with the corresponding chamber of the front half and with a connection, preferably inlet, of the corresponding cooling or heating liquid, while the rear half presents, centered on its minor base, a central orifice which is traversed by the shaft of the mill and by the inlet connection of the product to be ground; in that the rotor—attached to the free end of said shaft, situated inside the stator—consists of an element composed of two hollow truncated cones, a front and a rear one, joined together by their open major bases and the front truncated cone having its minor base closed and with a central recess, preferably also truncated cone-shaped but of inverted position and with its minor base toward the inside of the rotor and joined to the mill shaft end, which recess is disposed matching the aforesaid separator means, and the rear truncated cone has its minor base closed and traversed by said shaft to which it is joined; and in that the rotor has in its interior means for conducting the cooling or heating liquid, disposed around the shaft, joined to the latter and connected to the corresponding internal line thereof, which discharge said liquid in the vicinity of the inner walls of the rotor, and it also has collecting means of said liquid connected to the corresponding internal line of said mill shaft, for its return out of it.

Further, said mill is characterized in that the seal means between the stator and the shaft present a first hermetic seal, situated at the grinding chamber and comprising a ring lodged in a peripheral circular channel of the shaft, in cooperation with a circular retainer disposed in an offset of the inner wall of the minor base of the rear half of the stator—in the inner mouth of its central orifice traversed by the shaft—and applied tightly around said ring, which first seal is complemented by a second conventional hermetic seal situated at the outer part of said minor base.

The mill for triturating and breaking up solids predispersed in liquids, which is the subject of this Patent of Invention, eliminates the mentioned disadvantages of the known mills and contributes, among others, the advantages of a simpler design, lesser cost of manufacture, easy and simple access to the interior of the grinding chamber, simple maintenance, convenient cleaning and simple replacement or repair of its first hermetic seal.

The mill according to the present Patent of Invention offers the advantages that have been described above, in addition to others which will be readily evident from the example of realization of said mill described in greater detail below, to facilitate comprehension of the characteristics set forth before, and at the same time giving various details, for which purpose there are attached hereto drawings in which is shown, merely as an example and not limiting the scope of the present invention, a practical case of the mill for triturating and breaking up solids predisposed in liquids which is the subject of the invention.

Figure 2:
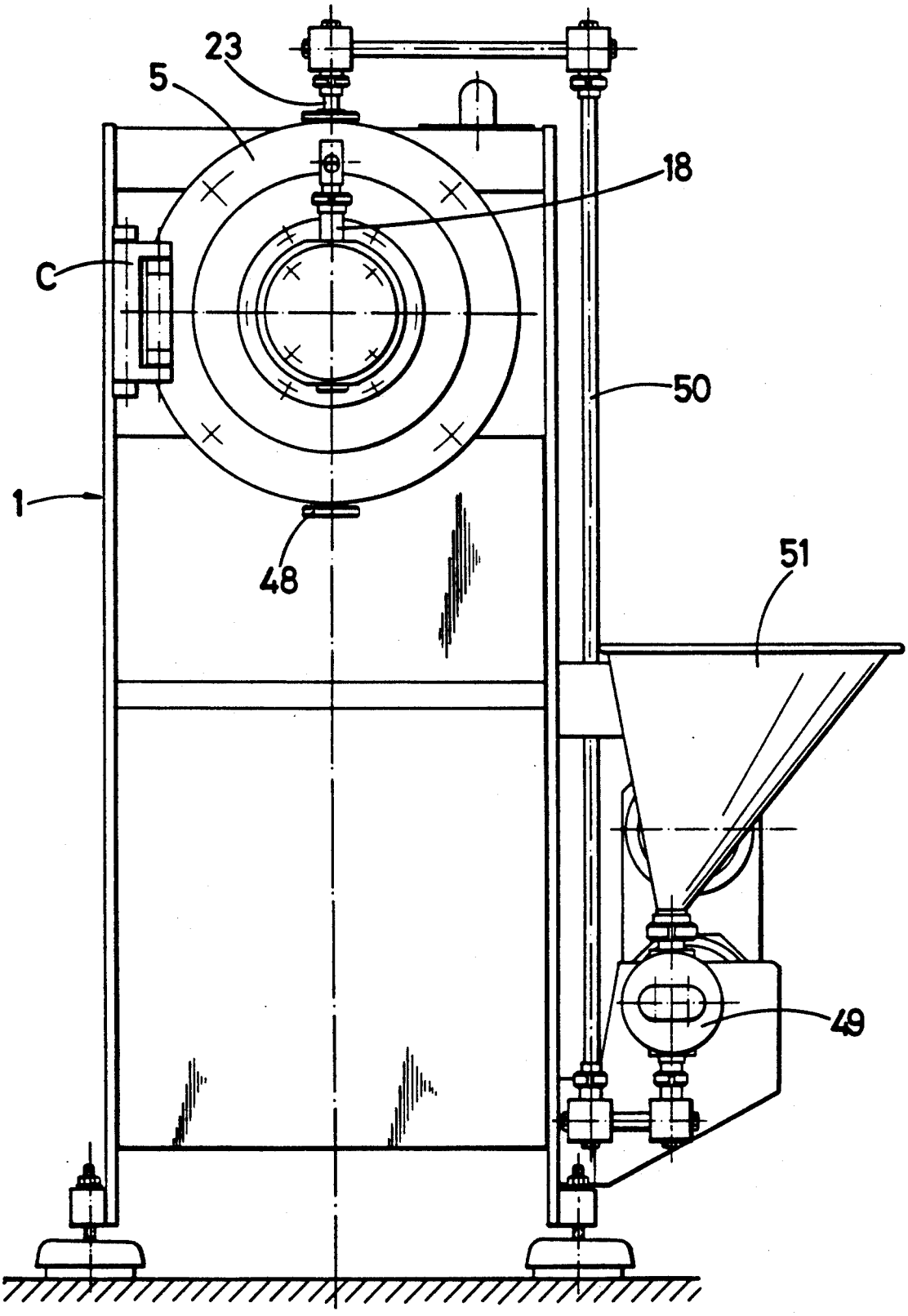
Figure 3:
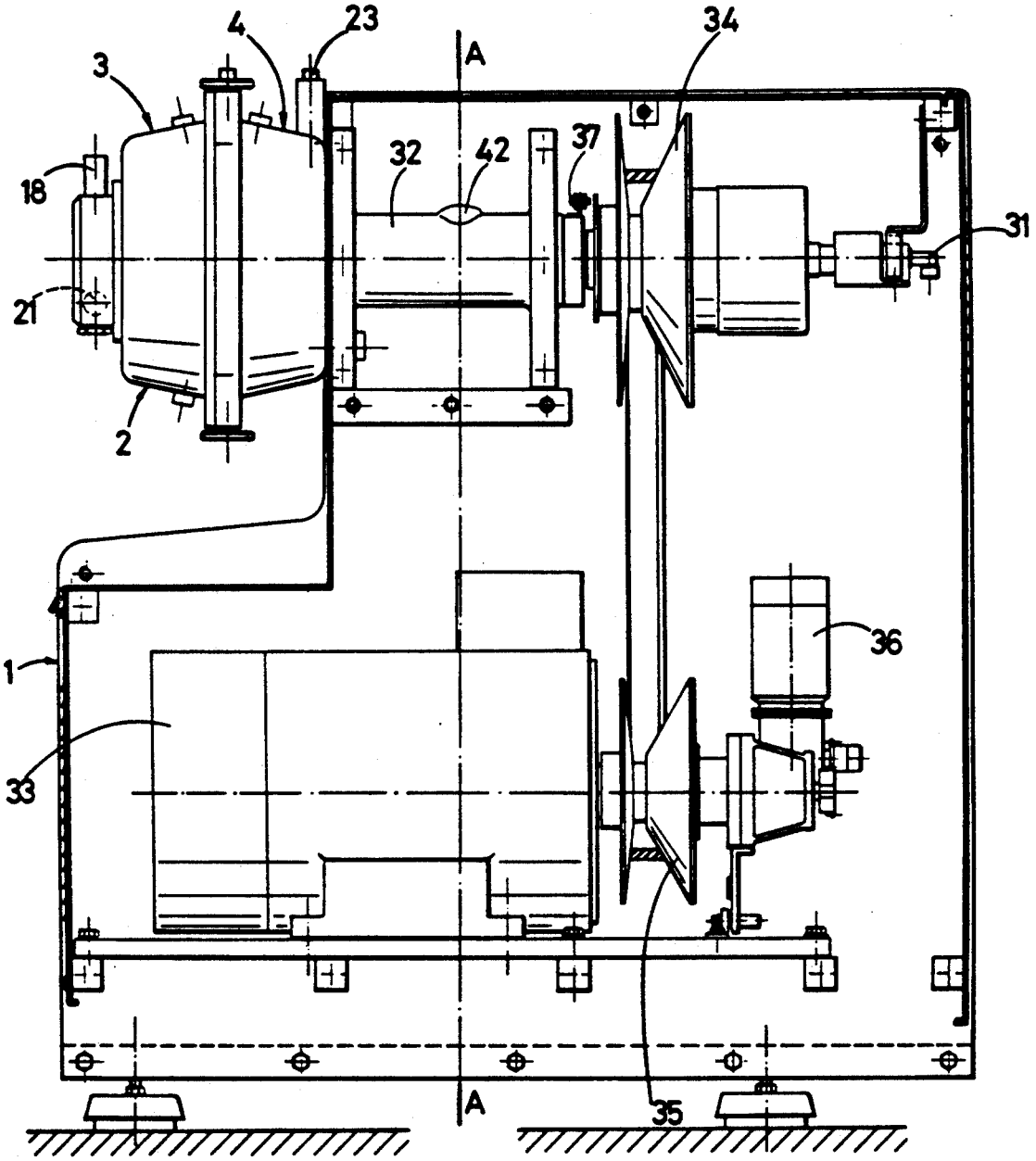
Figure 4:
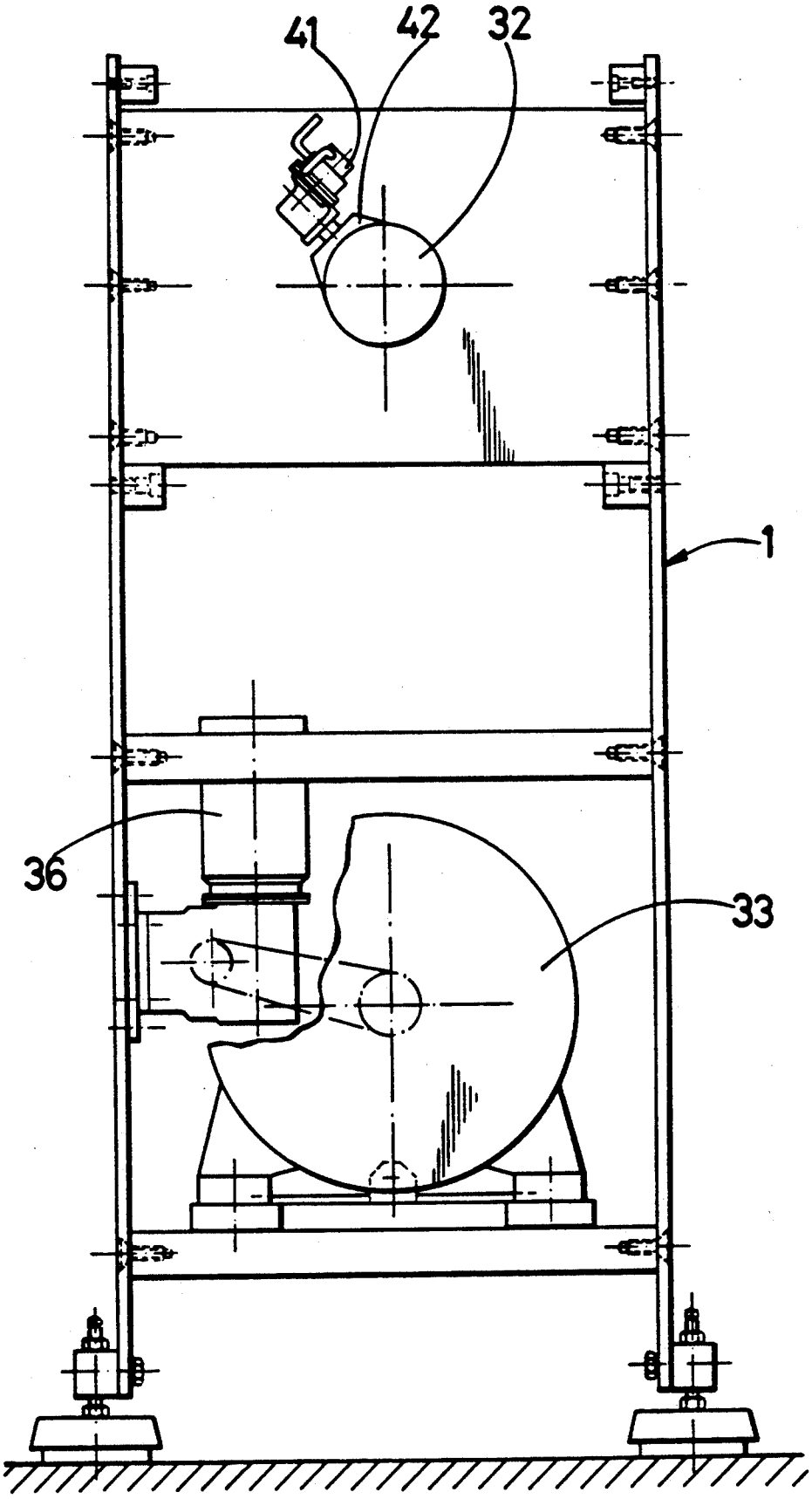
Figure 5A:
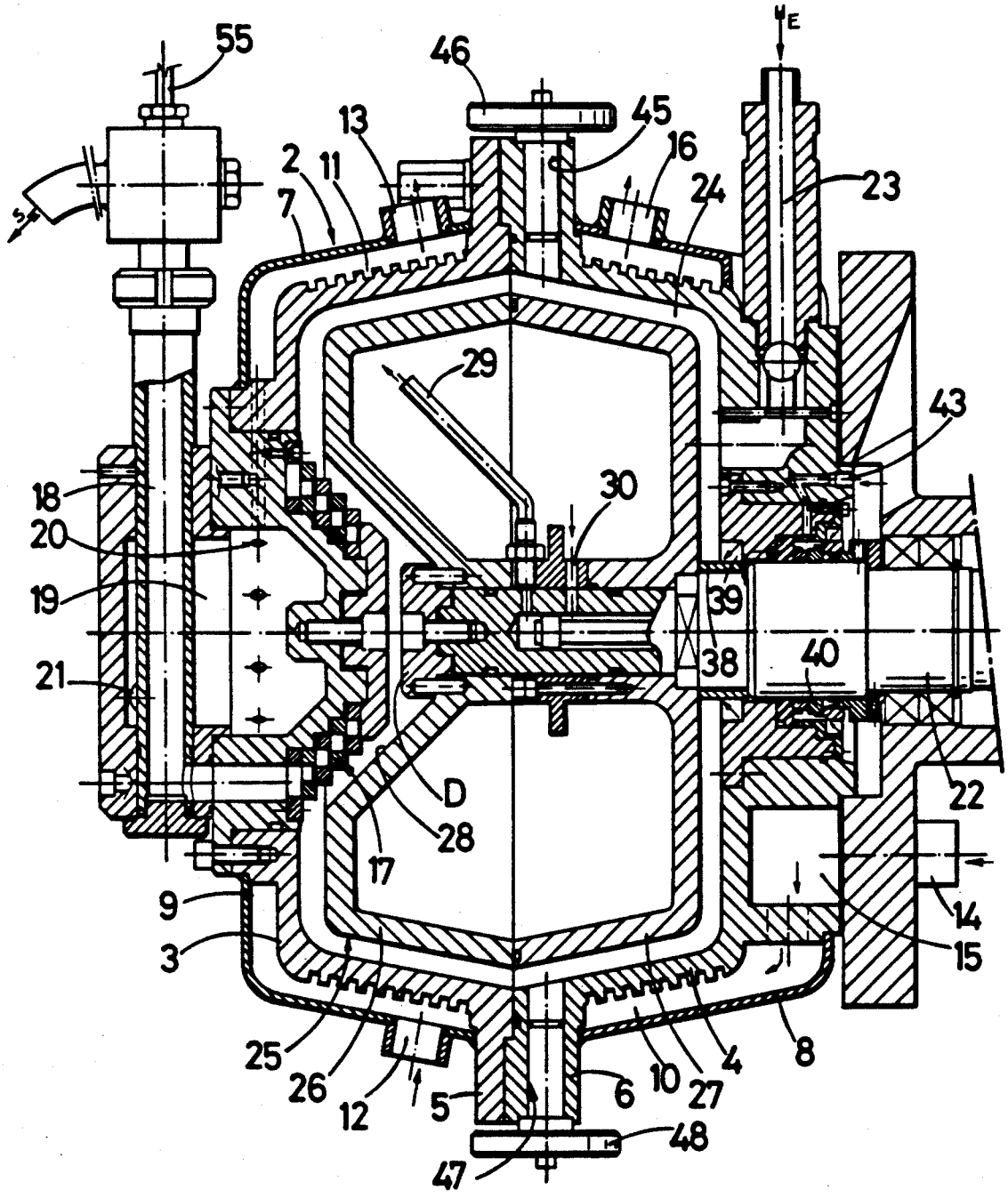
Figure 5B:
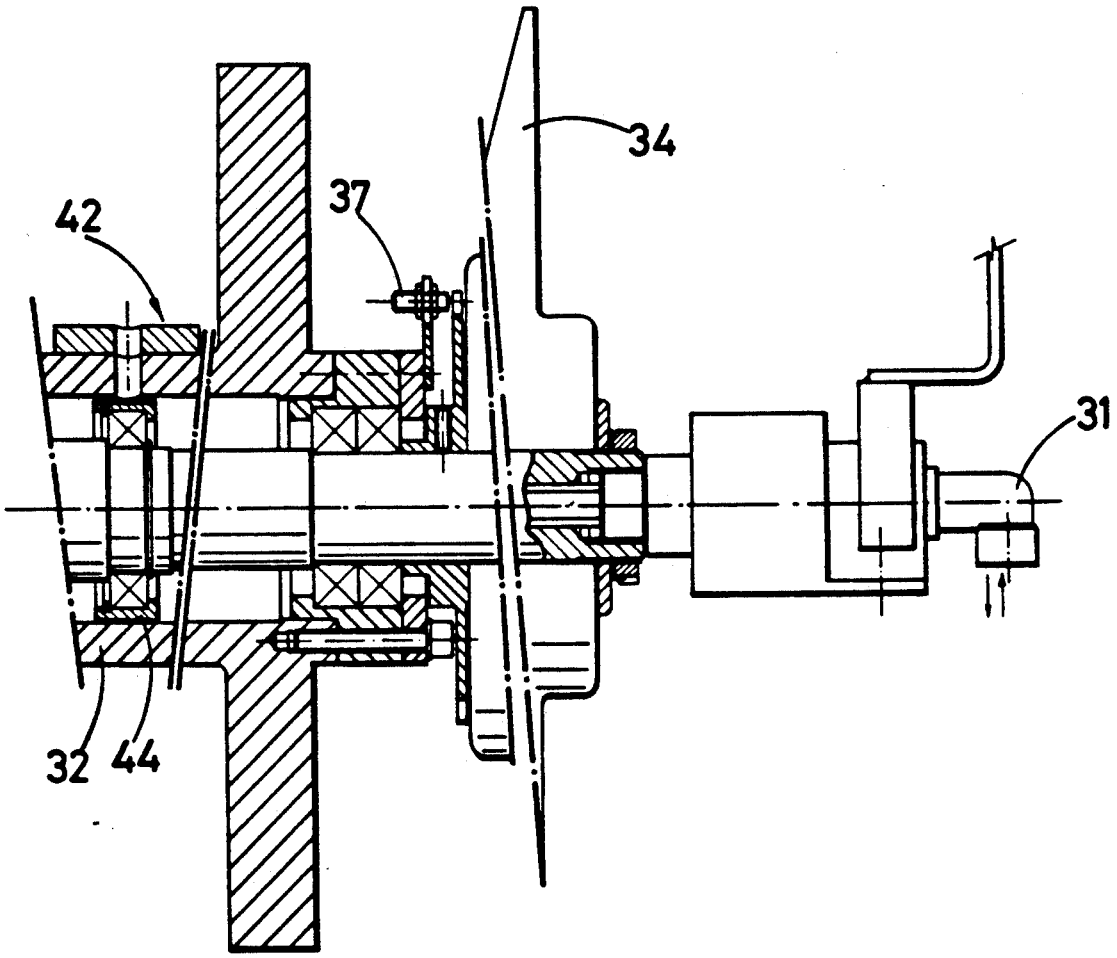

In the drawings, FIG. 1 shows a view in side elevation of the mill and FIG. 2 is a front view thereof;

FIG. 3 represents the mill according to a view in side elevation thereof, but without the right sidewall, and FIG. 4 is a view in conventional section along A—A of FIG. 3 and in which in turn a partial section has been made in the motor for driving the mill shaft so as to show a detail of the means for regulating the speed of said shaft;

and in FIGS. 5A and 5B a detail is shown in longitudinal section of the stator, rotor, shaft and supporting and bearing means thereof.

As shown in the drawings, the mill for triturating and breaking up solids predispersed in liquids comprises, according to the example of realization illustrated, a frame (1) for supporting and fixing the various organs of the mill and which permits supporting said mill, possibly adjustable in height, on the floor on which it is installed and, if desired, permits also its attachment thereto; and said frame comprises respective protection and trim coverings (FIGS. 1 to 4).

We shall call front the part of the mill situated more toward the exterior thereof and presenting the outlet of the ground product, and rear part thereof the opposite side presenting the inlet of the product to be ground, the right and left side of the mill being those as seen from its front.

On the frame is mounted a fixed element or stator (2) which is composed of two hollow truncated cone halves, a front one (3) and a rear one (4); said two halves have the minor bases closed and they are removably joined together by their major open bases (FIGS. 1, 3 and especially 5A). The major bases of the two halves (3) and (4) have outer flanges (5) and (6), in this instance circular ones, between which respective seal means are disposed, which flanges serve to make the two halves removable, either by screws or the like, or by hinges and hermetic locks, and in this latter case the operation of opening the element is facilitated; all this in such a way that the rear half (4) is the one that is mounted and fastened to the frame (1). The hinge (C) is seen in FIG. 2.

As in the treatment or grinding zone a temperature rise occurs due to excess inherent heat of such operation, and since that would adversely affect the product by the production of vaporizations and segregation of stabilizing dispersants, apart from the change of color of the ground product, respective cooling chambers are provided in conventional manner in the two halves (3) and (4), for which purpose both halves are provided with outer envelopes (7) and (8) defining between them and said halves the cooling chambers (9) and (10). It should be pointed out that these chambers are normally for cooling and, if and when applicable, for heating. On the outside of the respective half and/or on the inside of its envelope, said chambers may have grooves or annular or helicoidal deformations to facilitate the transmission of heat and, thereby, the corresponding cooling or heating (FIG. 5A showing that the two halves of the example have a grooving such as (11) on their inclined outer faces).

Each chamber (9) and (10) has an inlet and outlet connection for the respective cooling or heating liquid, so that chamber (9) has the inlet conduit (12) and the outlet conduit (13), while chamber (10) has the inlet conduit (14)—which is in communication with the antechamber (15) which communicates with chamber (10)—and the outlet conduit (16). The inlets as well as the outlets will be connected in turn with the respective cooling or heating system or systems external of the mill, and the cooling or heating liquid may be water or other products and will be impelled by forced feed means, such as pumps, or it may come from a general cooling or heating liquid system; alternatively the cooling or heating system of the mill may be integrated therein with the respective motor pump and liquid supply tank in which the respective cooling or heating takes place, for example, by means of coils, etc.

On its interior delimiting the grinding chamber, the front half (3) has, centered on its minor base, the grinding body separator (17), in the outlet zone of the product at the end of its treatment, which separator prevents the grinding bodies from coming out but lets the ground product pass. This separator represented in the figure is an invention of the applicant firm of the present Patent of Invention and has been the subject of Spanish Patent Application No. 9002767, but the mill being described in this example may have any other type of separator or sieve for the grinding bodies.

The front half (3) presents, on its exterior, the ground product outlet conduit (18), which in turn presents a cooling chamber (19) and, if and when applicable, heating chamber, which chamber communicates by the radial orifices (20) with the chamber (9) and with an inlet conduit not shown in FIG. 5A because of its position but of which can be seen part of its mouth (21) leading to said chamber (19), which inlet is for the cooling or heating liquid and its conduit connects with the respective cooling or heating system, the same as for the inlet conduits (12) and (14).

The three cooling and, if and when needed, heating circuits of the chambers (9), (10) and (19) are controllable independently and can be connected, if desired, with one another, particularly with regard to chambers (9) and (19) which are already connected together through the orifices (20), so that the cooling or heating liquid can enter through the conduits (12) and (21) and issue from the chambers (9) and (19) through the single conduit (13). Chamber (19) contributes supplementary cooling in the zone of separation between the grinding bodies and the ground product and in the exit zone of the latter, which represents an advantage in that it reduces the final temperature of said ground product.

The rear half (4) has, centered on its minor base, a central orifice which is traversed by the mill shaft (22) and also presents the inlet conduit (23) of the product to be ground which, in this case, presents also a non-return device consisting of a sphere and a spring holding it against a seat, producing a closure and so that the impulsion pressure of the product to be ground overcomes the antagonistic action of said spring and opens the passage to the grinding chamber (24), defined between the inner face of the stator and the outer face of the rotor (25) or rotating element fastened to the shaft (22).

The rotor (25) consists of an element composed of two hollow truncated cones, a front one (26) and a rear one (27), which are joined together by their open major bases, and the front truncated cone (26) has its minor base closed and with a central recess (28), which in this case is of truncated cone shape but in inverted position and with its minor base toward the inside of the rotor and joined to the outer end of the shaft (22) of the mill; the recess (28) is disposed opposite the separator (17); said recess may have any other suitable form, preferably correlative or matched to the actual form of the separator or sieve installed in the mill.

The rear truncated cone (27) has its minor base closed and with an orifice which is traversed by the shaft (22) to which it too is joined, as in the case of the front truncated cone (26). In this example, the two truncated cones (26) and (27) which make up the rotor are coupled together hermetically by their major bases, the edges of which have the necessary sealing means, which are used also in the union of said two truncated cones with the end of the shaft (22), both truncated cones being strongly coupled by conventional pressure and friction means which consist, in this case, of a kind of disk or pan (D) which is joined firmly to the extreme edge of the shaft by emans of a central screw and there being provided also rods disposed circumferentially between said pan and the minor base of the recess (28) of the truncated cone (26), to avoid any relative rotation between the rotor and its drive shaft.

Inside the rotor are means of conduction of the cooling and/or heating liquid, consisting of curved pipes, such as pipe (29), which propel the respective liquid into the rotor (25) for cooling or heating it, which pipes are disposed around the shaft (22), joined thereto and connected to an internal line which said shaft presents centrally and longitudinally, discharging said liquid near the inner walls of the rotor, the latter presenting also means for collecting said liquid, such as the conduit (30), which are connected in turn to a corresponding internal line of the shaft for its return to the outside thereof; and the shaft presents at its rear end and projecting outward the linkage device (31) of its longitudinal, central and internal lines with the corresponding cooling and, if and when applicable, heating system and through control and regulating means, which system may be the same that feeds the chambers (9), (10) and (19) of the stator, said device (31) maintaining the hydraulic hookup even though it remains fixed in space while the shaft rotates. The cooling or heating liquid fills the interior of the rotor and circulates in a controlled manner adjustable from outside the mill.

Shaft (22) is mounted overhung in supporting and bearing means (32) joined to the frame (1) of the mill and said shaft is caused to rotate by an electric motor (33) through transmission and speed variation means joined to the frame, which transmission and speed variation means may consist of the driven pulley (34) and the driving pulley (35), both linked by the respective belt, in this case a V-belt, and the pulley (35) being actuated to vary its diameter by a servomechanism (36) which acts on it via corresponding pinions and linkage chains (see FIGS. 3 and 4), the desired and appropriate speed variation of the shaft (22) being thus obtained, which is controlled, for example, by means of an inductive detector (37).

Between the stator (2) and shaft (22) seal means are disposed to prevent escape of the product which circulates continuously and forcedly through the grinding chamber (24), said seal means presenting a first hermetic seal, located at the grinding chamber (24) and comprising a ring (38) lodged in a circular peripheral canal of the shaft (22), in cooperation with a circular retainer (39) disposed in an offset of the inner wall of the minor base of the rear half (4) of the stator and, concretely, in the inner mouth of its central orifice which is traversed by the shaft (22), which retainer is applied tightly around said ring (38), all so that both the ring and the retainer are exchangeable (FIG. 5A). This first watertight seal is of simple construction and is easy to replace without affecting the shaft, and at the same time it cooperates assuring the work of the second hermetic seal (40), which is conventional and is located at the outer part of said minor base of the rear half (4).

The second hermetic seal (40) receives a lubricating cooling liquid (which may be of a nature compatible with the liquids in which the solids to be treated are predispersed) from a pump for example a pulsating or oscillating membrane pump (41)—FIG. 4—and mounted on a pedestal (42)—FIGS. 3, 4 and 5A); said pump (41) is not shown in FIGS. 3 and 5A. The second seal (40) receives the lubricating cooling liquid impelled by the pump (41) through its inlet conduit (43), which returns through another conduit not shown. Said cooling and lubricating liquid may in turn be cooled by conventional means, as for example a tank in which is introduced a cooling coil whose temperature can be controlled and regulated as needed. The pump (41) is driven via an oscillating rod (not shown) which is actuated in reciprocation by the rotation of the shaft (22) and through the eccentric ring (44) (FIG. 5B).

In the grinding chamber (24) are enclosed grinding bodies which, initially and before the corresponding grinding operation, are introduced into said chamber through an inlet conduit (45) of the stator and whose entrance is closed by a plug (46), and in the bottom part of the stator is an outlet conduit (47) of the grinding bodies when they are to be replaced, which outlet is closed by a plug (48). When the interior of the grinding chamber is to be cleaned, using the appropriate normally solvent products, the plug (46) may be replaced by another which has an orifice traversing it and which protrudes at the top with a short threaded sleeve, for coupling on the respective line of such cleaning liquids, and the same can be done also in connection with the lower plug (48).

During the treatment of the solids predispersed in liquids, the grinding chamber (24) is traversed continuously by said product, while the rotor (25) is rotating, owing to a means of impulsion of said product, consisting of a pump (49) which is linked, via line (50), with the inlet (23) of the product to be ground (FIGS. 1 and 2). Said pump is in turn supplied with the product to be ground discharged into the hopper (51), which product can come from a tank and be transported through corresponding lines or it may be discharged directly from a vessel containing it; also the possibility may be provided that the mill does not have on its frame the impulsion means or pump (49), in that the inlet (23) is coupled directly to a pressure system of the product to be ground existing in the factory section where the mill is installed, as well as the possibility of combining the action of the impulsion pump (49) and the pressure of an existing feed system.

In this example the pump (49) is driven by the electric motor (52) and through transmission and speed variation means (53) with their servomechanism (54), which are similar to the corresponding means and servomechanism for rotation of the shaft (22).

Obviously, the driving, transmission and speed variation means both of the pump (49) and of the shaft (22) may be any other conventional ones, as also the pump (41).

The geometric axis of the mill described and illustrated is horizontal, but it could be vertical, that is to say, the mill could be installed in a position rotated 90° in relation to what is represented, with the proper changes of position for the auxiliary means external to the body of the mill itself.

The operation of the mill in question is evident practically from what has been illustrated and described until now, and it should be pointed out that the product and the grinding bodies undergo an acceleration from the entrance of the product to the maximum diameter of the stator and which corresponds to the central transverse plane which contains the connecting surface between the two open major bases of the two hollow truncated cone halves (3) and (4) of the stator (2) and the connecting surface between the two open major bases of the two hollow truncated cones (26) and (27) of the rotor (25); so that in this zone of increasing diameter of the grinding chamber there occurs the impregnation of the solid materials of the product in treatment, as they are being ground by the action of the grinding bodies. In the part of the grinding chamber delimited between said central transverse plane and the separator (17) or other means such as a strainer, sieve, etc., the grinding means tend to move in a direction opposite to that of the current or flow of the product in treatment, due to the effect of increase of the centrifugal forces to which such bodies are subjected as a function of the increase of the radius of the rotor, causing a greater friction which facilitates the breaking up of the solid materials and favors their homogeneization; in any case the grinding means move in changing directions by variable impulses forming eddies in the aggregate formed by the product in treatment and the grinding bodies facilitating the homogenization resulting in a final fineness of the ground product which is homogeeous and constant at the end of the treatment of the total quantity of the respective product.

In FIG. 5A arrow E indicates the entrance of the product to be ground and arrow S the discharge of the ground product.

The control and drive means necessary for the operation of the mill may be provided, including the respective safety means, and the controls may be manual or automatic, including, if desired, automation of the grinding operations. The control and gradation of the operation of the mill are adjustable by its user as a function of the conditions required by the products to be treated; they may be carried out by means of a process programming unit, which may in turn include a printer. Variables to be controlled and graded may include, among others, the speed of the rotor, the exit temperature of the cooling liquid of the stator and of the rotor, with limit control, the internal pressure of the grinding chamber, also with limit control, and the temperature of the cooling liquid of the second hermetic seal; FIG. 5A shows the temperature sensor (55) at the exit of the ground product. All operations of the mill can be controlled by appropriate electric, pneumatic, hydraulic, or electronic means or combinations thereof.

It should be noted that in the realization of the mill for triturating and breaking up solids predispersed in liquids, of the present invention, all detail variants may be applied which experience and practice may suggest as to form and dimensions, both absolute and relative, number of structural parts, materials employed therein and other circumstances of an accessory nature, and there may be introduced whatever modifications of design detail are compatible with the essence of what is claimed, since all this is comprised in the spirit of the following claims.

I claim:

1. Mill for triturating and breaking up solids predispersed in liquids, of the type which comprises a frame on which is mounted a fixed element or stator, with a jacket for either cooling or heating the product being treated, in whose interior is disposed a rotating element or rotor fastened to a shaft disposed along the longitudinal axis of the mill and mounted overhung on corresponding supporting and bearing means attached to the frame of the mill, whose shaft has internal lines for cooling media and rotor heating media, and is made to rotate by actuating means through corresponding transmission and speed variation means attached to the frame, there being defined between said stator and rotor a grinding chamber in which grinding bodies are enclosed which are initially introduced into said chamber through a closable entrance of the stator, at the lower part of which is a likewise closable outlet for their evacuation, the grinding chamber being traversed by the product in treatment while the rotor rotates owing to impulsion means of said product, which are moved by actuating means and via transmission and speed variation means, the stator having an inlet for the product to be treated, communicating with the outlet of the impulsion means and an outlet of the ground product, in whose outlet zone are disposed separator means which prevent the grinding bodies from coming out but permit the passage of the ground product, there being disposed between the stator and the shaft seal means for preventing leakage of product which circulates in a continuous and forced manner through the grinding chamber; characterized in that the stator is composed of two hollow truncated cone-shaped halves, a front and a rear one, with their minor bases closed and joined together by their open major bases in a removable manner, which major bases have outer flanges between which seal means are disposed, and which halves are provided with outer envelopes defining respective cooling or heating chambers, each chamber having an inlet connection and an outlet connection for the respective cooling or heating liquid; in that said front half presents, centered on its minor base and in its interior, separating means for the grinding bodies and, on its exterior, the outlet of the ground product, which in turn has a cooling or heating chamber, communicating with the corresponding chamber of the front half and with an inlet connection for the corresponding cooling or heating liquid, while the rear half presents, centered on its minor base, a central orifice which is traversed by the shaft of the mill and by the inlet connection of the product to be ground; in that the rotor, attached to the free end of said shaft, situated inside the stator, consists of an element composed of two hollow truncated cones, a front and a rear one, joined together by their open major bases and the front truncated cone having its minor base closed and with a central recess of truncated cone-shaped but of inverted position and with its minor base toward the inside of the rotor and joined to the mill shaft end, which recess is disposed matching the aforesaid separator means, and the rear truncated cone has its minor base closed and traversed by said shaft to which it is joined; and in that the rotor has in its interior means for conducting the cooling or heating liquid, disposed around the shaft, joined to the latter and connected to the corresponding internal line thereof, which discharge said liquid in the vicinity of the inner walls of the rotor, and rotor also has collecting means of said liquid connected to the corresponding internal line of said mill shaft, for its return out of the rotor.

2. Mill for triturating and breaking up solids predispersed in liquids, according to claim 1, characterized in that the seal means between the stator and the shaft present a first hermetic seal, situated at the grinding chamber and comprising a ring lodged in a peripheral circular channel of the shaft, in cooperation with a circular retainer disposed in an offset of the inner wall of the minor base of the rear half of the stator in the inner mouth of its central orifice traversed by the shaft and applied tightly around said ring, which first seal is complemented by a second conventional hermetic seal situated at the outer part of said minor base.

* * * * *